US005830083A

United States Patent [19]

Saint-Victor

[11] Patent Number: 5,830,083

[45] Date of Patent: Nov. 3, 1998

[54] CYLINDER SWINGING AND LANDING TO A MALE EXTENSION

[76] Inventor: Emmanuel Saint-Victor, P.O. Box 450991, Atlanta, Ga. 31145

[21] Appl. No.: 72,251

[22] Filed: May 4, 1998

[51] Int. Cl.[6] ..... A63B 67/10

[52] U.S. Cl. ..... 473/506

[58] Field of Search ..... 473/505, 506, 473/507, 508, 514, 515; 273/329, 330, 331

[56] References Cited

U.S. PATENT DOCUMENTS

| | | | |
|---|---|---|---|
| 609,390 | 8/1898 | Hollstein | 473/506 |
| 1,527,532 | 2/1925 | Alcaraz | 473/506 |
| 1,556,794 | 10/1925 | Manson | 473/506 |
| 2,498,509 | 2/1950 | Santiago | 473/506 |

*Primary Examiner*—William H. Grieb

*Attorney, Agent, or Firm*—Hughes & Kaplan; Barry E. Kaplan

[57] ABSTRACT

A challenging and patience developer toy. This invention has a handle perpendicular to a four ended receptacle shaped like a cross. The four ends constitute the male extensions and form the axes of the male connector. The male extensions are: a peg, a cup, a fin and a cross-fin. Extending from the point of intersection of the four male extensions, at the opposite end, from the handle is a short piece of string. Attached to this string is a part of the toy that I refer to as the female connector. The female connector is a cylinder with one of its circular bases attached to the string. It has a central hole of a size corresponding to the peg of the male connector. It has a circular void concentric to the central peg hole of a size corresponding to and complementary to the edge of the cup on the male connector. It also has a groove diametrically passing through the central hole and the concentric circular void and a second groove diametric and perpendicular to the first diametric grove.

7 Claims, 5 Drawing Sheets

CYLINDER SWINGING AND LANDING TO A MALE EXTENSION

BACKGROUND OF THE INVENTION

This invention relates to a cylinder that swings into the air and lands to a male extension.

Forty years ago my father fabricated a toy for me. The toy is composed of three interjacent components. One is the "peg" which is a cylindrical two inch piece of wood, its diameter is two eighth of an inch, the held portion of the toy. The second component is the "string", a one and one quarter foot piece of yarn, which is tied in one knot at the upper fifth portion of the peg. The third component the "cylinder" is attached to the other end of the string. The cylinder itself is a light weight object made of wood. Its diameter is an inch and a half, and its width an inch. It has a hole opening through the lower half of its base, the size and shape matching that of the upper portion of the peg like lock and key. The object of this game was to land the cylinder's hole opening onto the upper portion of the peg while holding the bottom of the peg. The game began with the peg in the player's hand and the cylinder dangling below by its string. The strategy was to propel the cylinder into the air above the peg by tugging on the string, but tugging with such a controlled force that the cylinder will come down orderly rather than spiraling chaotically in a random direction. A player has won the game when they have successfully land the cylinder's hole onto the upper portion of the peg.

Although, I did enjoy playing with the toy, I realized that the toy was not challenging enough and needed a better means of holding it. Thus it is desirable to provide a cylinder swinging and landing to a male extension that offers many more challenges in which the user may start with peg and advance to the other parts as his/her skill merits.

It is desirable to provide a toy with an holding means which facilitate the user to rotate the toy along the axis of the handle such that the desired limb of the male connector is facing upwards to receive the female connector.

SUMMARY OF THE INVENTION

The present invention is a cylinder swinging and landing to a male extension toy. The toy includes three interjacent components. The fitter, or the male connector, the string and the cylinder or female connector. When the toy is held in a neutral position the handle is facing down. Attached and perpendicular to the handle is a four-handed receptacle shaped like an "X". This "X" constitutes the axes intersection of the male connector which contains the four male extensions. The first limb of the receptacle has a tip that narrows into a smaller peg. At the end and diametrically opposite of the peg the axis expands into a cup, looking down on the toy and moving to the limb counterclockwise from the cup you will find a single bladed fin and diametrically opposite to the single bladed fin you will find the cross bladed fin with a pair of perpendicular fins.

Extending from the point of intersection of all the axes, at the opposite end, from the handle is a short piece of string of about one and one quarter foot piece length. Attached to this string is a part that I refer to as the female connector or the cylinder.

The female connector or the cylinder is a light weight object made of plastic. Its diameter is two inches and its width one and a half of an inch. One of its circular bases is attached to the string. The other circular surface is carved in the following manner: There is a central hole of a size corresponding to the peg on the central connector. There is a circular void concentric to the central peg hole of a size corresponding to and complementary to the edge of the cup on the male connector. This circular groove divides this circular surface into two circles. A smaller circle and a larger circle. There is a groove diametrically passing through the male hole, the concentric circular void and the circles. There is a second groove diametric and perpendicular to the first diametric groove.

The object of the game is to land a cylinder opening onto a desired male extension. In use, the user holds the toy by the handle. The user rotates the toy along the axis of the handle such that the desired male extension of the male connector is facing upwards. The user jerks his/her hand abruptly causing the string to pull the female connector into the air. As the female connector starts to fall the user manipulates the male extension by holding the handle and attempts to catch the female connector with the complementary part on the male connector. A user could start with any particular male extension but it is recommended to start with the peg and advance to the other parts as his/her skill merits. The peg will fit to the hole of the circular base. The cylindrical cup will align with the circular void. The fin will align with either of the diametric void. The cross-fin requires that the user aligns the cross-fin to the cross-shaped void.

BRIEF DESCRIPTION OF THE DRAWING

The various features, advantages and other uses of the present invention will become more apparent by referring to the following detailed description and drawing in which.

Figure 1:
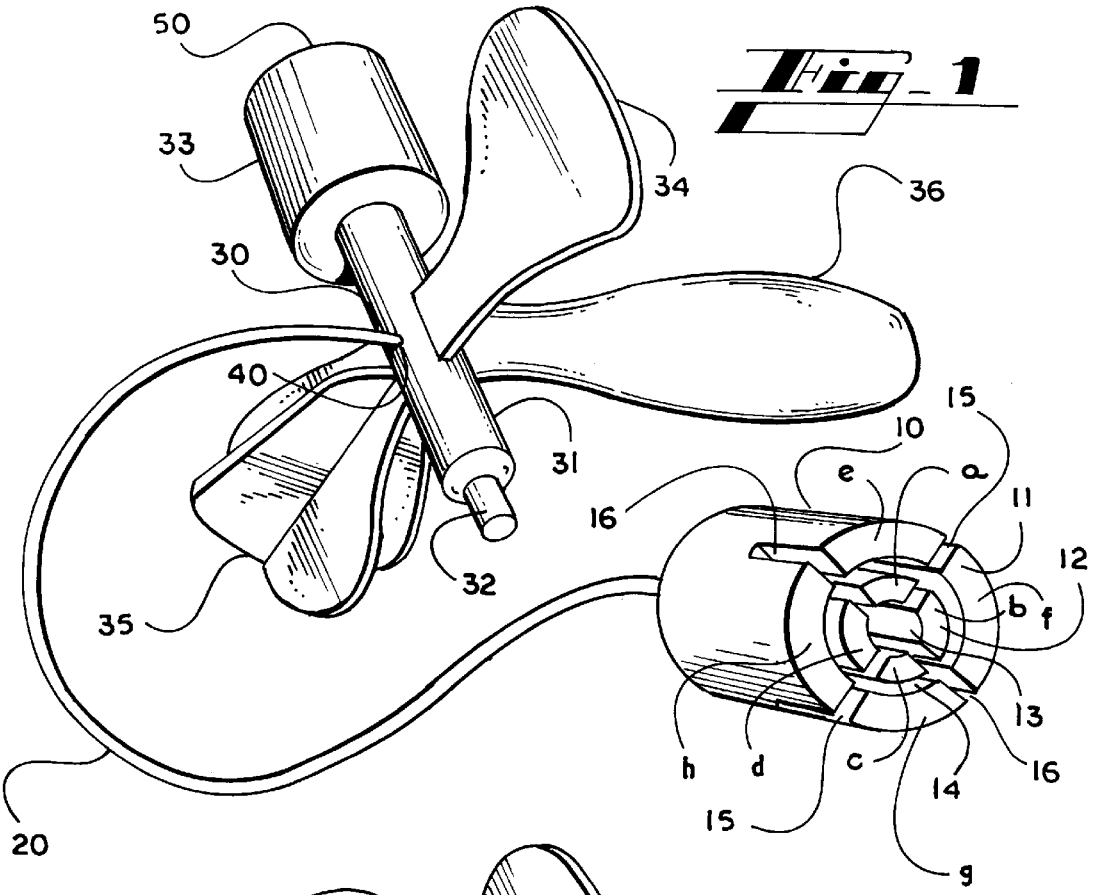
FIG. 1 is a perspective view of the cylinder swinging and landing to a male extension toy of the present invention.

| REFERENCES AID | |
|---|---|
| 66 | Cylinder swinging and landing to male extension |
| 10 | Cylinder (female connector) |

-continued

| REFERENCES AID | |
|---|---|
| 11 | Larger circle |
| 12 | Smaller circle |
| 13 | The hole |
| 14 | Circular void |
| 15 | Diametric groove #1 |
| 16 | Diametric Groove #2 |
| 556 | Cross-shaped groove |
| 20 | String |
| 30 | Fitter (male connector) |
| 31 | Male connector axes intersection |
| 32 | peg |
| 33 | cup |
| 34 | fin |
| 35 | cross-bladed fin |
| 36 | handle |
| 40 | bore at the male connector |
| 41 | knot at the male connector |
| 50 | edge of the cup |
| 55 | cup's aperture |
| 80 | bore at the base of the cylinder |
| 81 | knot (inside the cylinder) |
| a, b, c, d = quarters of circle 12 | |
| e, f, g, h = quarters of circular 11 | |

DESCRIPTION OF THE PREFERRED EMBODIMENTS

Throughout the following description and drawing, an identical reference numeral is used to refer to the same component shown in multiple figures of the drawing.

Referring now to the drawing and to FIG. 1 in particular, there is depicted a cylinder swinging and landing to a male extension toy 66 which produces a challenged amusement during use.

When held in a neutral position the handle 36 is facing down. Attached and perpendicular to handle 36 is a four ended receptacle shaped like a "cross". The four ends constitute the male extensions and form axes intersection 31 of the male connector 30. The first limb of the receptacle has a tip that narrows into a smaller peg 32. At the end diametrically opposite of the peg, the axis expands into cup 33. Looking down on the toy and moving to the limb counterclockwise from cup 33 you will find single bladed fin 34 and diametrically opposite to single bladed fin 34 you will find cross-bladed fin 35 with apair of perpendicular fins.

Extending from the point of all the axes, at the opposite end, from handle 36 is string 20. Attached to string 20 is a part I will refer to as female connector 10, also called the cylinder.

Female connector 10 is a cylinder with one of its circular bases attached to string 20. The other circular surface is carved in the following manner:

There is central hole 13 of a size corresponding to peg 32 on male connector 30.

There is circular void 14 concentric to central peg hole 13 of a size corresponding to and complementary to edge 50 of cup 33 of male connector 30. Circular void 14 separates the solid circular surface into two divisions. A smaller circle 12 and larger circle 11.

There is groove 15 diametrically passing through central hole 13, smaller circle 12, circular void 14 and larger circle 11. Groove 15 creates two equal divisions of smaller circle 12 and two equal divisions of larger circle 11.

There is second groove 16 diametric to the divisions created by groove 15 and perpendicular to groove 15. These two grooves (groove 15 and groove 16) result in a cross-shaped groove (cross-shaped void) which I refer to with an imaginary numeral 556 not shown in any figure to avoid confusion in showing groove 15 or groove 16 separately, cross-shaped 556 created a total of 4 divisions of smaller circle 12 which are: a,b,c,d and also created 4 divisions of larger circle 11 which are: e,f,g,h.

Figure 2:
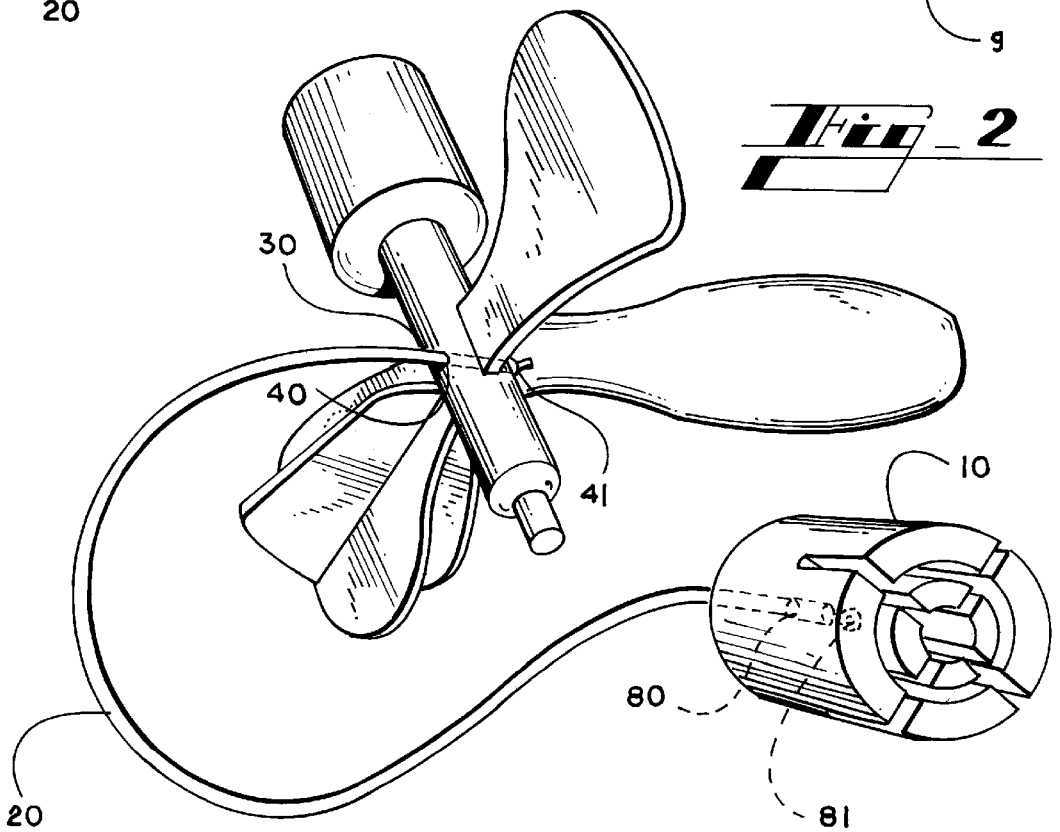
FIG. 2 is another perspective view of the cylinder swinging and landing to a male extension toy made transparent, so, the inside components could be shown clearly.
Figure 3:
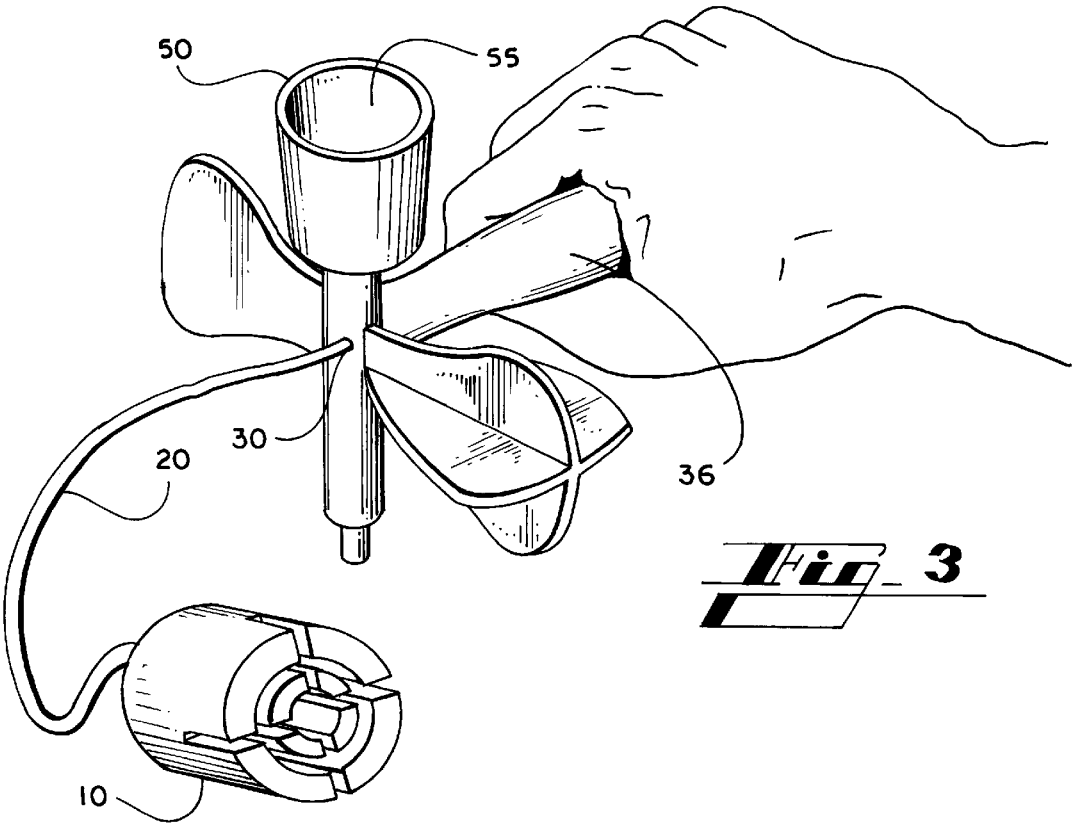
FIG. 3 is a view of the present invention when held by a real human hand.
Figure 4A:
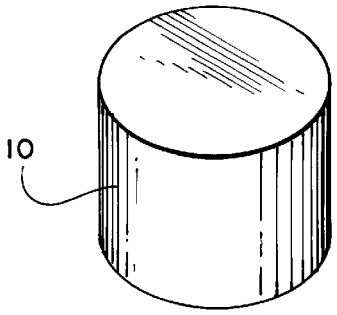
FIGS. 4A, 4B, 4C, 4D, 4E, 4F, 4G show some of the many ways that this invention can be fabricated. It is shown from a plain cylinder to a cylinder with only one hole, a cylinder with only one diametric groove, a cylinder with a circular void etc.
Figure 4B:
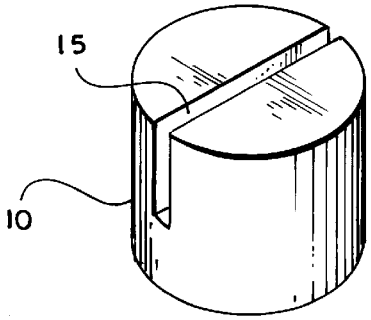
Figure 4C:
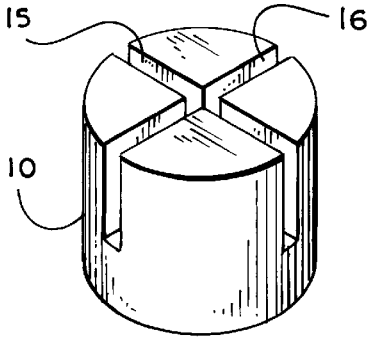
Figure 4D:
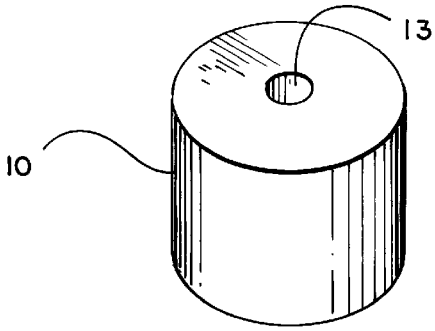
Figure 4E:
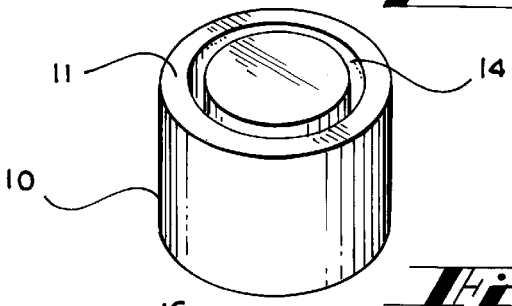
Figure 4F:
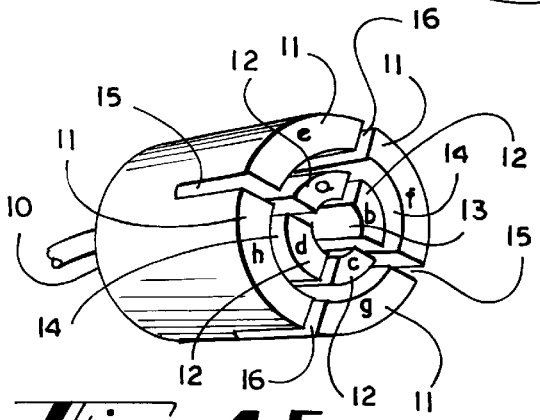
Figure 4G:
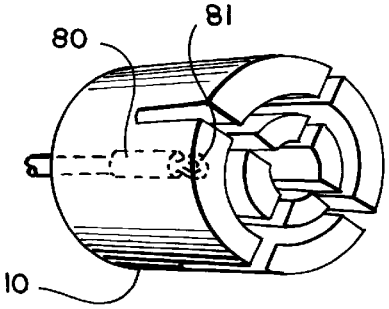

FIG. 2 shows the cylinder swinging and landing to a male extension made completely transparent. This enables anyone to differentiate bore 80 at the base of the cylinder 10 and knot 81 inside said cylinder 10. It allows anyone to see the knot 41 at the male connector 30 and also bore 40 of said male connector 30. FIG.3 shows a human hand holding the handle 36. It also makes visible edge 50 and aperture 55 of cup 33. FIGS. 4A, 4B, 4C, 4D, 4E, 4F, 4G are different steps of cylinder 10 from a plain cylinder 10 to a very carved cylinder 10. FIG. 4B shows cylinder 10 with only groove 15. While, 4C shows the complete cross-shaped void 556 containing groove 16 in addition of diametrical groove 15. FIG. 4D is an illustration where cylinder 10 has only hole 13 while FIG. 4E is another illustration of cylinder 10 where only circular void 14 is carved. FIG. 4F is a well carved cylinder 10; this example, in addition to the combination of all the steps previously explained, contains a nice view of quarters a,b,c,d of circle 12 and e,f,g,h of circle 11 created by the cross-shaped void 556.

Female connector 10 and male connector 30 are formed of any suitable material, such as wood, metal or plastic. However, plastic is a preferred material. In particular, a plastic which exhibits phosphorescent properties is preferred. This enables the female connector 10 and male connector 30 to glow in the dark after they have been exposed to light and provides a unique visual appearance for the toy when it is used in the dark. By way of example only, string 20 when fully extended has a planar portion of about fourteen inches it is extended between bore 40 at the male extensions intersection 31 to bore 80 at the base of cylinder 10 (which is also called the female connector).

String 20 may be formed of any suitable flexible material although nylon is preferred over cotton for durability, longer useful life and smooth operation.

By way of example only, cylinder 10 diameter is two inches and its width one and half of an inch. Circular void 14, diametric groove 15, diametric groove 16 are half of an inch deep with a width of two sixteenth of an inch. Fin 34, cross-bladed Fin 35, edge of cup 33 are one sixteenth of an inch width. Hole 13 has a diameter of six sixteenth of an inch peg 32 has a diameter of four sixteenth of an inch.

In use and with references to FIGS. 5–8 the user holds the toy by handle 36. The user will rotate male connector axes intersection 31 such that the desired male extension is facing upwards. The user jerks his/her hand abruptly causing string 20 to pull female connector 10 into the air. As the female connector 10 starts to fall the user manipulates male connector 30 by holding handle 36 and attempts to catch female connector 10 with the complementary part on male connector 30. The user should start with peg 32 and advance to cup 33, fin 34 and cross-bladed fin 35 as his/her skill merits.

Cylindrical cup 33 will align with circular void 14.

Fin 34 will align with either the diametric void 15, or diametric void 16.

Cross fin 35 requires that the user aligns the cross shaped void 556 to it.

Peg 32 will naturally align to hole 13.

Figure 5:
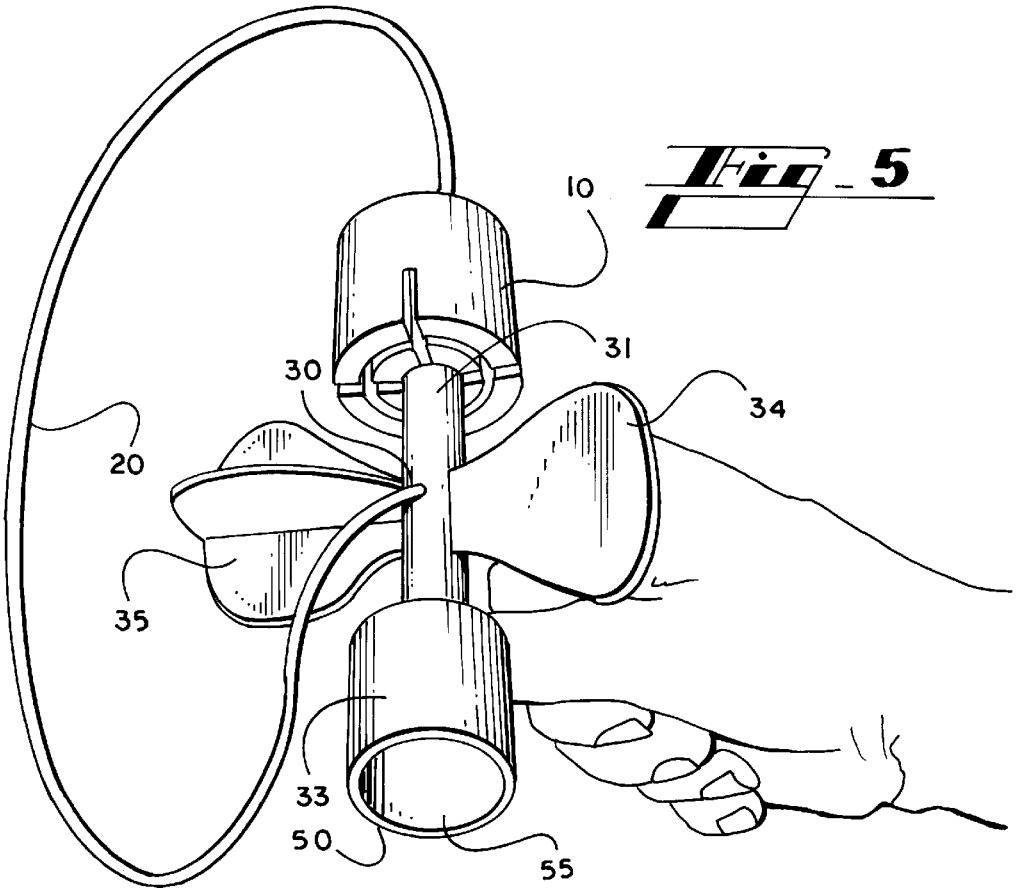
FIG.5 is a perspective view of the cylinder swinging and landing to a male extension showing the toy after a successful landing of the hole of the cylinder onto the upper portion of the peg of the male connector.

FIG. 5 shows a successful landing of hole 13 of female connector 10 onto the upper portion of peg 32 of male connector 30.

Figure 6:
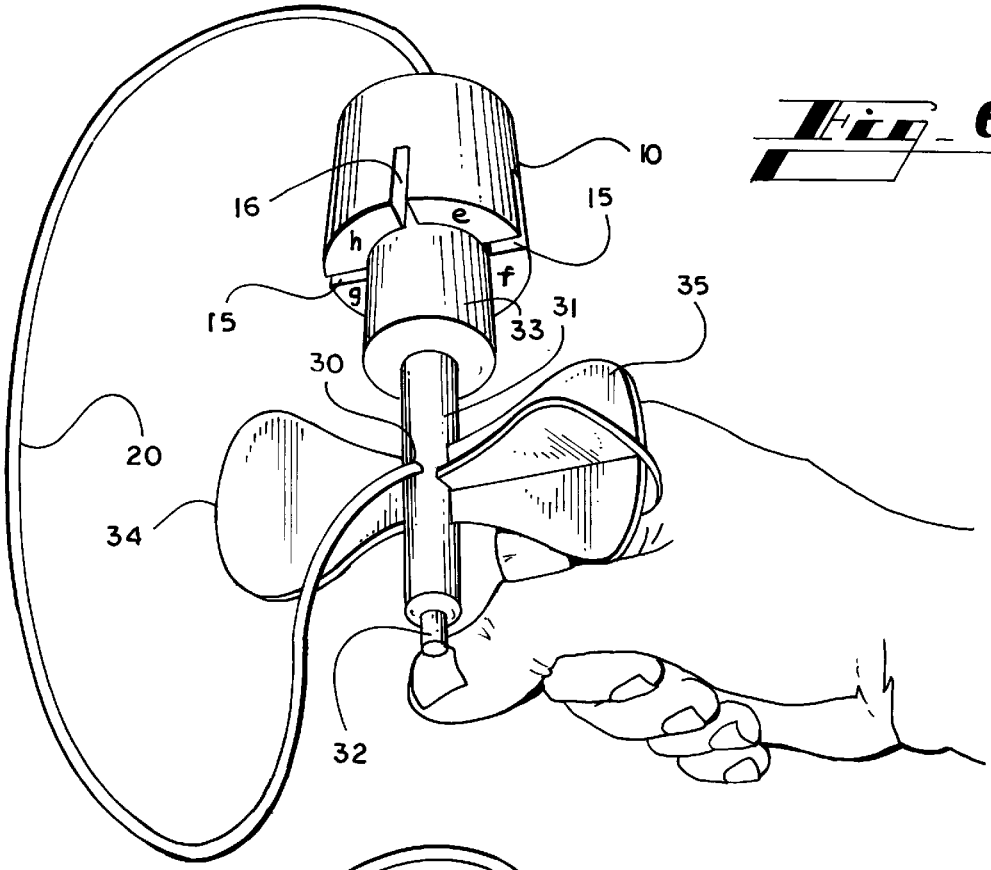
FIG.6 is a perspective view of the cylinder swinging and landing to a male extension showing the toy after a successful landing of the circular void of the cylinder onto the upper portion of the cup of the male connector.

FIG. 6 is another successful landing of circular void 14 of female connector 10 onto the upper portion of cup 33 of male connector 30.

Figure 7:
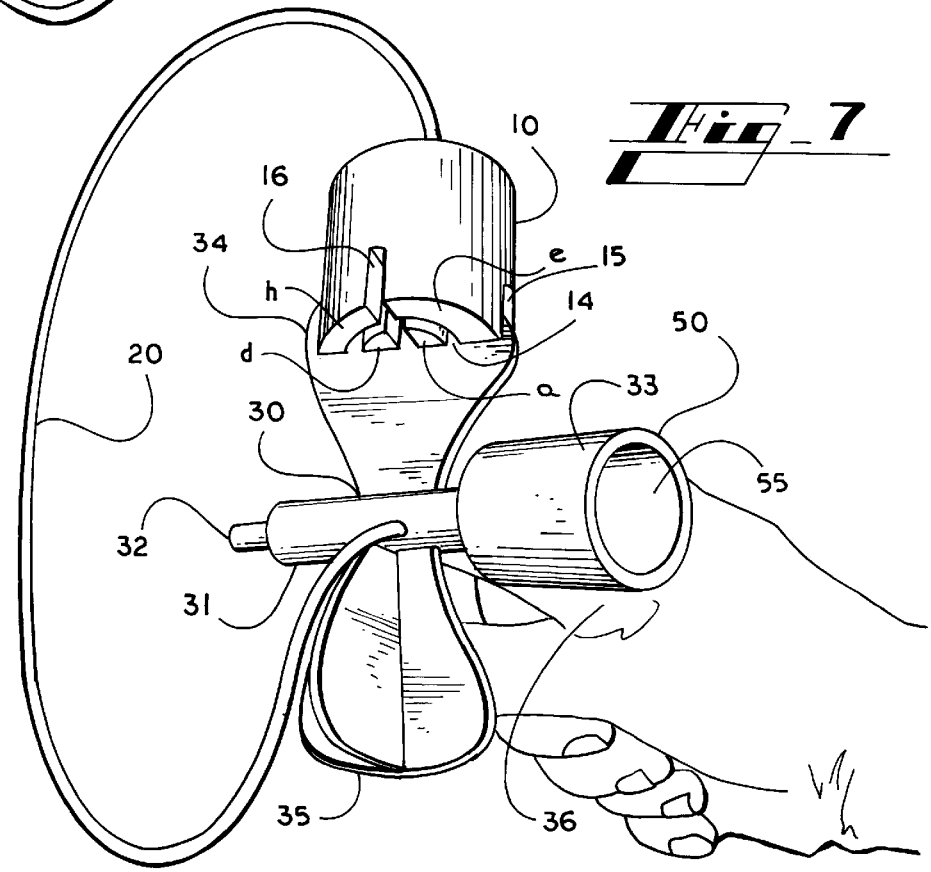
FIG.7 is a perspective view of the cylinder swinging and landing to a male extension showing the toy after a successful landing of one of the diametric groove of the cross-shaped void of the cylinder onto the upper portion of the fin of the male connector.

FIG. 7 has shown a successful landing of diametric groove 15 of female connector 10 onto the upper portion of fin 34 of male connector 30.

Figure 8:
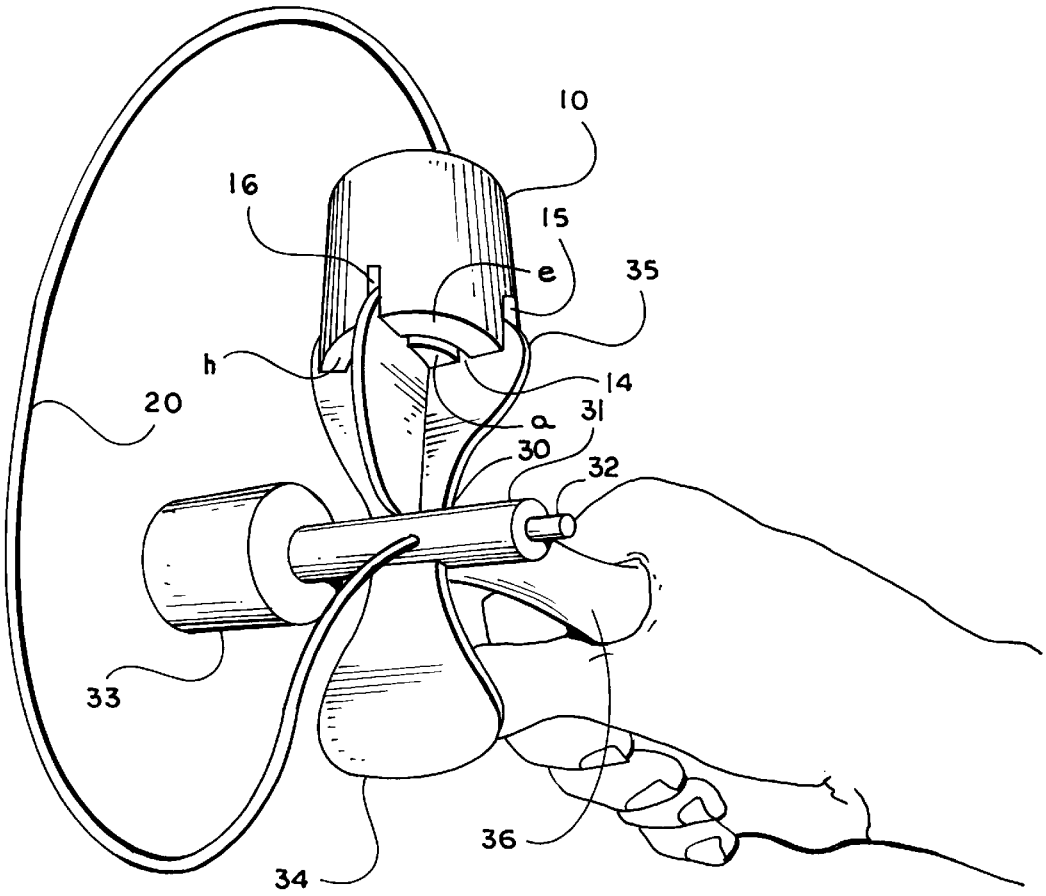
FIG. 8 is a perspective view of the toy after a successful landing of the cross-shaped void of the cylinder onto the upper portion of the cross-fin of the male connector.

FIG. 8 shows the most difficult landing. This landing requires expertism or luck. It shows a successful landing of cross-shaped void 556 of female connector 10 onto the upper portion of cross-Fin 35 of male connector 30.

The preferred and optimumly preferred embodiments of the present invention have been described herein and shown in the accompanying drawings to illustrate the underlying principles of the invention, but it is to be understood that numerous modifications may be made without departing from the spirit and the scope of the invention.

What is claimed is:

1. A toy comprising:

A) A fitter or male connector which when held in a neutral position the handle is facing down, attached and perpendicular to the handle is a four ended receptacle shaped like an "X", the "X" forming the axes of the male extensions a) the first limb of the receptacle has a tip that narrows into a smaller peg, b) at the end diametrically opposite of the peg the axis expands into a cup, c) Looking down on the toy and moving to the limb counterclockwise from the cup is a single bladed fin, d) diametrically opposite to the single bladed fin is a cross bladed fin with a pair of perpendicular fins, B) extending from the point of intersection of all the axes, at the opposite end, from the handle is a short piece of string, which is attached to a female connector.

C) The female connector is a cylinder with one of its circular bases attached to the string, the other circular surface is carved in the following manner, a) there is a central hole of a size corresponding to the peg on the male connector, b) there is a circular void concentric to the central peg hole of a size corresponding to and complementary to the edge of the cup on the male connector, c) there is a groove diametrically passing through the central hole, the concentric circular void, and the two circles, d) There is a second groove diametric and perpendicular to the first diametric groove.

2. The toy of claim 1 wherein the cylinder and the fitter are formed of phosphorescent plastics material.

3. The toy of claim 1 in which the cup is being formed of a substantially planar central portion and a peripheral rim portion, the edge of the peripheral rim portion extending outward from the central planar portion.

4. The toy of claim 1 in which the peg is formed at one end of the limb at the male connector to fit the central hole of the female connector.

5. The toy of claim 1 in which the cup is formed at one end of a limb of the male connector to fit into the circular void of the female connector.

6. The toy of claim 1 in which the fin of the male connector being made to fit into any of the diametric grooves of the cross-shaped void of the female connector.

7. The toy of claim 1 in which the cross-fin of the male connector being made to fit into the cross-shaped groove of the female connector.

* * * * *